US005877475A

United States Patent [19]

Hecht et al.

[11] Patent Number: 5,877,475

[45] Date of Patent: Mar. 2, 1999

[54] RADIANT HEATING BODY

[75] Inventors: Josef Hecht, Erlenmoos; Roman-Hartmut Wauer, Kisslegg, both of Germany

[73] Assignee: AKO-Werke GmbH & Co. KG, Wangen, Germany

[21] Appl. No.: 791,221

[22] Filed: Jan. 31, 1997

[30] Foreign Application Priority Data

Feb. 7, 1996 [DE] Germany ..... 196 04 306.9

[51] Int. Cl.[6] ..... H05B 31/68

[52] U.S. Cl. ..... 219/449; 219/464

[58] Field of Search ..... 219/449, 450, 219/464, 465, 510, 516

[56] References Cited

U.S. PATENT DOCUMENTS

| | | | |
|---|---|---|---|
| 4,388,520 | 6/1983 | McWilliams | 219/464 |
| 4,770,545 | 9/1988 | Takada et al. | 219/450 |
| 4,810,857 | 3/1989 | Goessler | 219/464 |
| 4,812,624 | 3/1989 | Kern | 219/450 |
| 5,176,451 | 1/1993 | Sasada et al. | 219/450 |
| 5,258,736 | 11/1993 | Kristen et al. | 219/449 |
| 5,270,519 | 12/1993 | Higgins | 219/464 |

FOREIGN PATENT DOCUMENTS

| | | |
|---|---|---|
| 0 141 923 | 5/1985 | European Pat. Off. . |
| 7315318 | 7/1973 | Germany . |
| 33 15 657 A1 | 10/1984 | Germany . |
| 40 22 846 A1 | 1/1992 | Germany . |

*Primary Examiner*—Mark H. Paschall
*Assistant Examiner*—Sam Paik
*Attorney, Agent, or Firm*—Scully, Scott, Murphy & Presser

[57] ABSTRACT

There is provided a radiant heating body (1) in which the temperature sensor (thermocouple element 12) of a temperature limiter is fitted at the hottest point on the underside of a glass ceramic plate (3). By virtue of that specific arrangement of the temperature sensor (12), with each type of heating arrangement, temperature measurement is effected directly at the hottest type-specific point. The temperature sensor (12) is desirably fitted in a ceramic tube (15) in order electrically to insulate it and to shield it from ambient heat.

14 Claims, 4 Drawing Sheets

RADIANT HEATING BODY

BACKGROUND OF THE INVENTION

1. Field of the Invention

The invention relates to a radiant heating body having a carrier for at least one radiant heating resistor, a plate, disc or the like which covers the radiant heating resistor, and a temperature limiter or temperature monitor.

Radiant heating bodies of that kind usually have a carrier for a heating means which is to be electrically operated and which comprises heating resistors. Such heating resistors are covered by a glass ceramic plate, high-quality steel plate or the like plate or disc, which with its top side serves as a hot plate. By virtue of their design configuration, radiant heating bodies of that kind, together with the glass ceramic plate, form a carrier space which is substantially closed outwardly and in which the radiant heating resistors are fitted. In order to prevent overheating of the glass ceramic plate, temperature limiters or temperature monitors are used in relation to such radiant heating bodies.

2. Discussion of the Prior Art

DE 33 15 657 A1 discloses an electrical cooking appliance with a glass ceramic plate having a central opening with a sleeve which is fitted therein and in which a temperature sensor is disposed. In that arrangement the temperature sensor is held in the sleeve displaceably by a spring force to a position of bearing against an upper abutment, whereby, when the temperature sensor bears against the abutment, it projects somewhat above the surface of the glass ceramic hot plate.

Another design arrangement and configuration of a temperature limiter for a glass ceramic cooking unit is known from EP 0 141 923 B1. In that case the temperature sensor extends preferably substantially along a diameter over the cooking area or however in somewhat laterally displaced relationship with respect to the cooking area. The temperature sensor itself comprises a plurality of bar portions disposed in a unitary, elongate outer tube. The temperature sensor of that design configuration makes it possible to communicate to the temperature sensor the different temperature influences resulting from the at least two heating surfaces, so that the response temperature on the part of the temperature sensor is actually independent of whether one or two heating surfaces are in operation.

In the case of radiant heating bodies or radiant heating means it is fundamentally important and also prescribed by safety requirements that the temperature at the underside of the glass ceramic plate does not exceed a maximum value in order to prevent the glass ceramic plate from being damaged. For that reason, temperature limiters are used, which monitor the set maximum value at the underside of the ceramic glass plate and which ensure that the maximum temperature of for example 600° C. or 700° C. at the underside of the glass ceramic plate is not exceeded.

It is known however that the temperature at the underside of the high-quality or glass ceramic plate is not the same at all points, but depends substantially on the routing configuration of the heating conductor or conductors and the dimensioning thereof. If now a temperature distribution in respect of the high-quality steel or glass ceramic plate is plotted in a chart, it can be seen that there are so-called hot spots which only rarely occur in the detection region of the per se known sensor bar of the temperature limiter.

SUMMARY OF THE INVENTION

The object of the present invention is to provide a radiant heating body of the kind set forth in the opening part of this specification, in which a temperature sensor of a temperature limiter detects the temperature of a high-quality steel or glass ceramic plate in a spot-wise or almost spot-wise manner and transmits that temperature for example in the form of electrical voltage differences to the regulating device of the radiant heating body.

The particular advantage of the invention is considered to lie in the fact that the temperature sensor or detector of a temperature limiter is directed precisely onto the hottest point or spot of the underside of the plate and thus attains the specified object in the optimum fashion. In accordance with the invention such direction means that the hottest region to be detected can be disposed as the so-called measurement zone directly on the plate or also between the plate of high-quality steel or glass ceramic and the radiant heating means. The measurement zone does not necessarily have to be only in point or spot form but can also be provided between the radiant heating means and the plate or cover, as a diameter of for example about 15 mm. Detection of temperature then generally occurs in point or spot form. In that way the function of a temperature monitor is fulfilled and suitable cooking operations can be conducted because this provides for temperature limitation and a reaction to a rise in temperature and also a fall in temperature.

Although the problem that the heating means do not have an equal temperature distribution but involve a quite definite temperature profile is known per se, in the case of the known temperature limiters the sensor is generally fitted into the centre of the radiant heating means because this is deemed to be the best solution from the production engineering point of view, with a sufficiently large amount of space. In order to arrive at a guaranteed measurement result in terms of temperature, with that construction, the electronic evaluation system must provide for an association of heating means type, output and temperature difference from the measurement point to the hottest point of the glass ceramic plate. That is technically highly complex and complicated and in addition gives rise to high levels of cost. For that reason in practice the switch has been made to indirectly effecting temperature detection linearly over the centre of the heating means by way of an expansion bar.

It is precisely those disadvantages that are avoided by the features of the present invention because now the temperature sensor, for example a thermocouple element, is disposed at the type-specific hottest point or spot, in any type of radiant heating body. This involves direct temperature measurement. Accordingly, irrespective of the variety in terms of heating means alternatives, in signal processing, it is only necessary to fix one limit temperature in the form of a voltage. That limit temperature is so selected that the limit temperature of the glass ceramic plate is observed under all operating conditions. Nonetheless the limit temperature can advantageously be selected to be so high that the operational suitability of the entire system is optimised, which inter alia results in shorter cooking start-up times. The direct temperature measurement obviates the need for the reduced limit temperature which is required when indirect measurement is employed, by virtue of tolerances and the different heat distribution. Nonetheless the same degree of reliability and certainty is achieved. The sensor of the temperature limiter is extended to be as close as possible to the underside of the glass ceramic plate. An optimum is achieved when the sensor touches the underside of the glass ceramic plate.

BRIEF DESCRIPTION OF THE DRAWINGS

An embodiment of the invention is illustrated in the drawing. In the drawing.

DETAILED DESCRIPTION OF THE PREFERRED EMBODIMENTS

Figure 2:
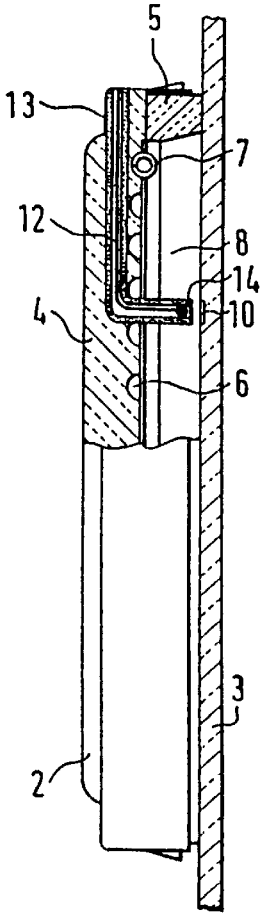
FIG. 2 is a partial section through the radiant heating body taken along line II—II in FIG. 1.

The radiant heating body 1 essentially comprises a dish-like carrier 2 whose bottom is arranged substantially parallel to the glass ceramic plate 3. The carrier 2 is made from metal. Fitted into the carrier 2 is the insulating carrier 4 comprising ceramic insulating materials which are put into a structured form for example by being poured out and distributed, pressed and dried. Fitted onto the insulating carrier 4 is an outer edge 5 which in the illustrated embodiment shown in FIG. 2 is formed from a material which is different from the insulating carrier 4. The outer edge 5 however may equally well be produced in one piece with the insulating carrier 4. Disposed in the top side of the insulating carrier 4, which is towards the glass ceramic plate, are the paths or channels 6 which are arranged in a spiral or coil form, for receiving the radiant heating resistor or resistors 7.

The glass ceramic plate 3 rests on the annular outer edge 5, whereby there is a free closed space 8 between the radiant heating resistors 7 and the underside of the glass ceramic plate 3.

Figure 1:
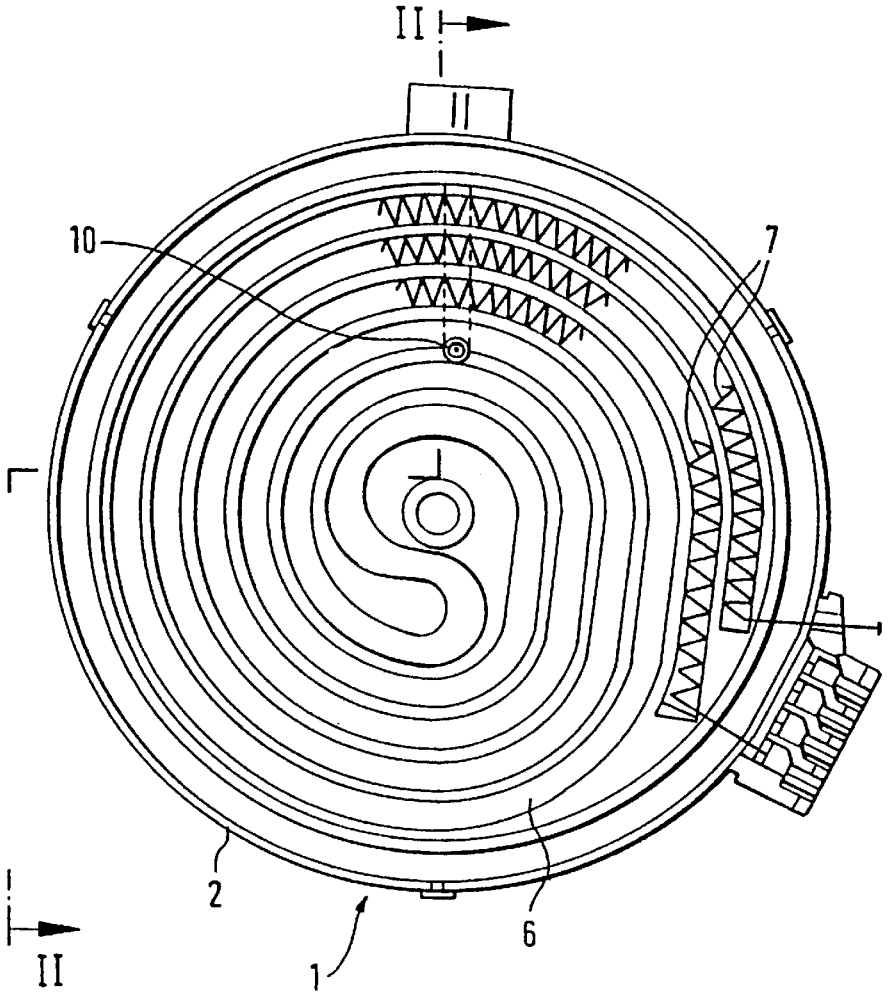
FIG. 1 shows a plan view of a radiant heating body.
Figure 3:
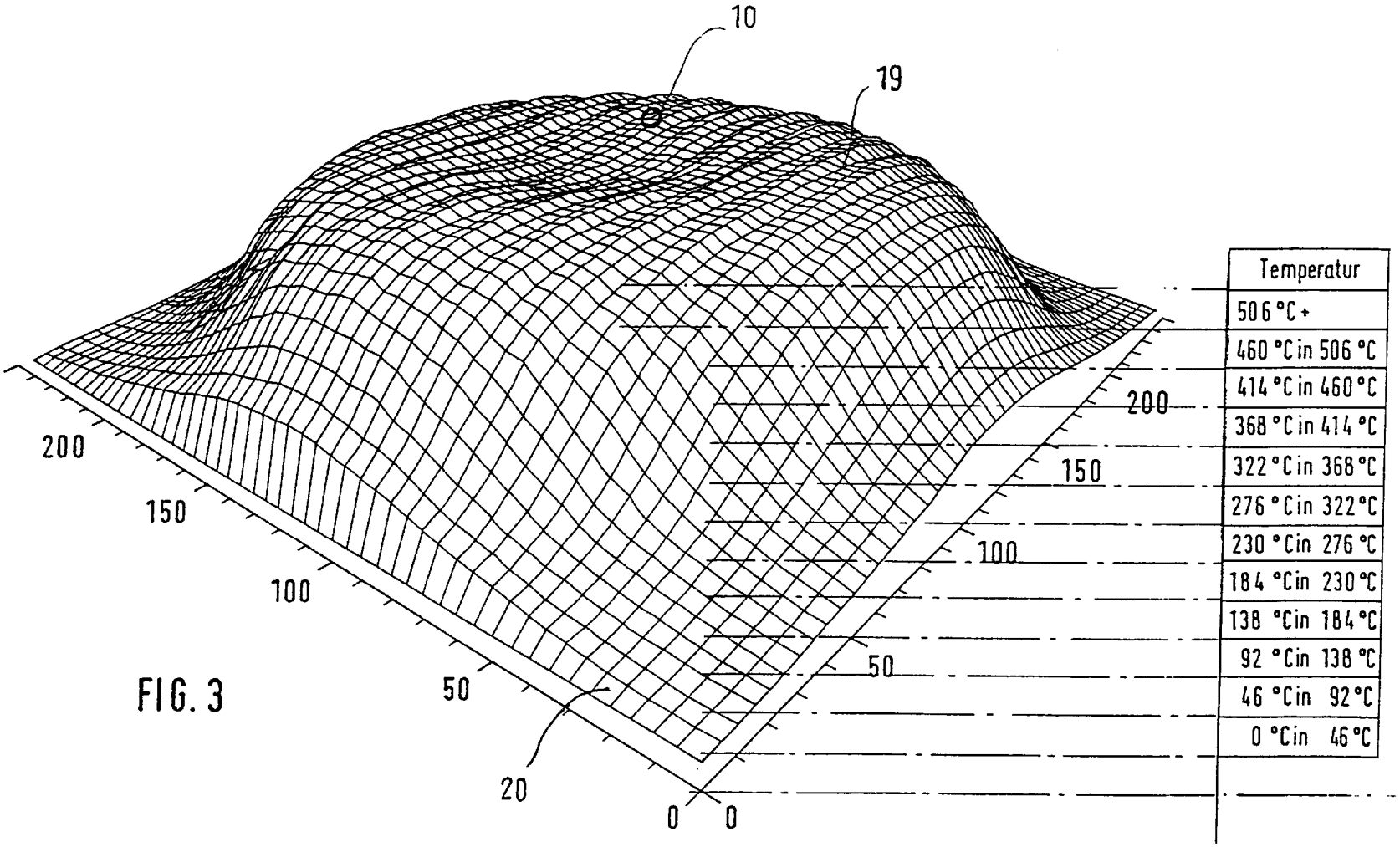
FIG. 3 shows the temperature distribution curve of a radiant heating body as shown in FIG. 1.

Now, the radiant heating body 1 shown in FIG. 1 has for example a temperature distribution as shown by the chart in FIG. 3. It will be seen from the FIG. 3 chart that the low temperatures of the glass ceramic plate 3 occur in the outer regions 20 while the whole of the central region 9 has the high temperatures. Due to the curve configuration in the FIG. 3 chart however it will be apparent to the man skilled in the art that the central region 19 also involves a noticeable fluctuation in temperature which is essentially caused by the routing of the radiant heating resistors 7. The hottest spot 10 on the underside of the glass ceramic plate 3 can be ascertained from the FIG. 3 chart in a mathematical and geometrical relationship. In accordance with the example in FIG. 3 the hottest spot 10 is assumed to occur at the position illustrated, which in the chart is the highest point, and how it is then transferred onto the radiant heating body illustrated in FIGS. 1 and 2.

The temperature limiter 11 comprises a temperature sensor or detector 12 which is disposed in the interior of a small tube 13. As shown in FIG. 2, the arrangement has a quartz tube 13 which is extended radially from the exterior to the hottest spot 10 and which is laid in the insulating carrier 4. Below the hottest spot on the underside of the glass ceramic plate 3 the quartz tube 13 is bent round at a right angle whereby the upwardly open end 14 of the quartz tube 13 is directed onto the hottest spot 10. The temperature sensor 12 is disposed with its outer end at a small spacing relative to the underside of the glass ceramic plate 3 and is directed exactly onto the hottest spot 10.

Figure 4:
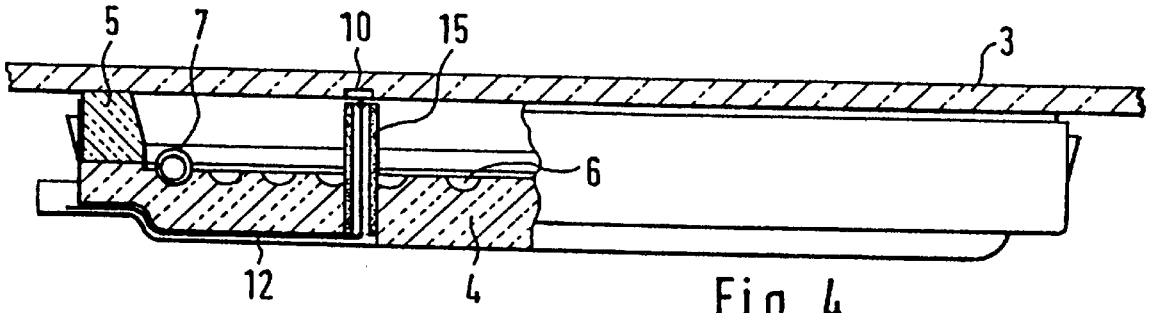
FIG. 4 shows a partial section of the radiant heating body taken along line II—II in FIG. 1 with another thermocouple element.

In FIG. 4 the thermocouple element (temperature sensor 12) is disposed in a radial passage between the bottom of the carrier 2 and the insulating carrier 4. Beneath the hottest spot 10 the thermocouple element 12 is bent round at a right angle and extends in an upstanding ceramic tube 15 which terminates at a small spacing beneath the glass ceramic plate 3.

Figure 5:
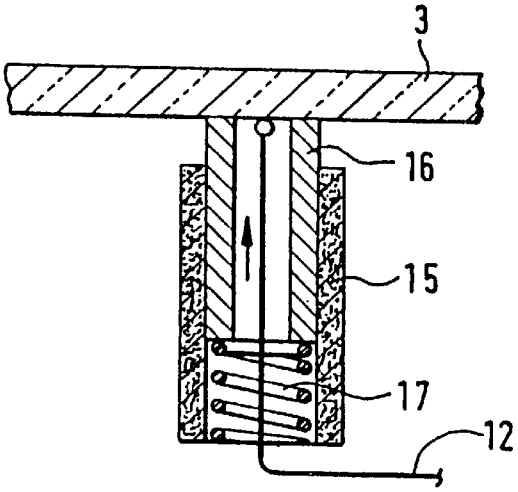
FIG. 5 is a sectional view of the thermocouple element.
Figure 6:
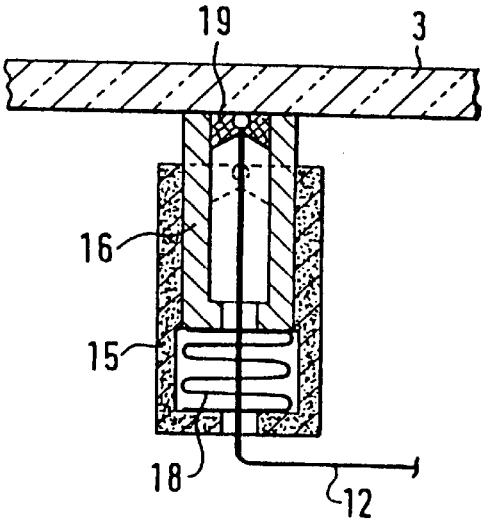
FIG. 6 is a sectional view of another design of the thermocouple element.

As FIG. 5 shows, fitted into the ceramic tube 15 as the outer casing or sleeve there is also an inner casing or sleeve 16 within which the temperature sensor 12 extends until it comes into contact against the underside of the glass ceramic plate 3. The inner sleeve 16 is subjected to the force of a spring 17 whereby the inner sleeve is continuously pressed against the underside of the glass ceramic plate 3. As shown in FIG. 6 the inner sleeve 16 is subjected to the force of a so-called thermo-bimetal spring 18, the arrangement thereby providing that in the cold condition of the radiant heating body 1 or the glass ceramic plate 3 the inner sleeve 16 is disposed at an axial spacing relative to the underside of the glass ceramic plate 3. In the hot operative condition of the glass ceramic plate 3 the inner sleeve 16 is pressed against the underside of the glass ceramic plate 3 by the bimetal spring 18. The temperature sensor 12 is embedded with its outer end in an insulating material 19 within the inner sleeve 16 and bears in punctiform contact against the underside of the glass ceramic plate 3.

As the above-indicated examples show the ceramic tube 15 or the inner sleeve 16 may be open with the end which is towards the glass ceramic plate 3. The end can also be closed, as is shown in FIG. 6. Alternatively closure can be effected by an adhesive or other sealing material. That has the advantage of preventing oxidation and ageing of the thermocouple element 12. In the example shown in FIG. 6 the temperature sensor 12 contacts the underside of the glass ceramic plate 3 only under the influence of temperature.

FIGS. 7 to 10 show further embodiments of a horizontal mode of installation of the temperature sensor 12. It will thus be seen from FIG. 7 that the temperature sensor 12 is fitted in a casing tube which for example can be a quartz tube, a metal tube or a ceramic tube 13. The sensor head 20 of the temperature sensor 12 is covered by a cap 21 which can be fitted onto the outer tube 13, thereby providing a thermal and radiation insulation effect. The sensor head 20 is disposed with the cover cap 21 in the hottest region 10 which is between the plate 3 and the radiant heating means 7 and which is emphasised by broken lines.

Figure 7:
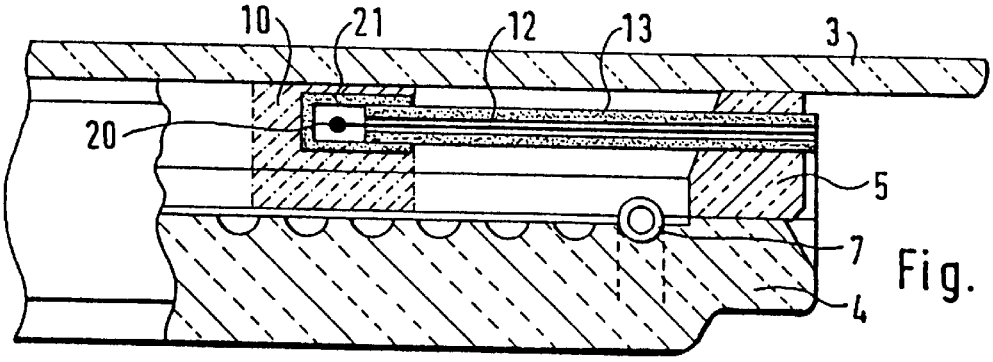
FIG. 7 is a sectional view of another radiant heating body of another kind.
Figure 8:
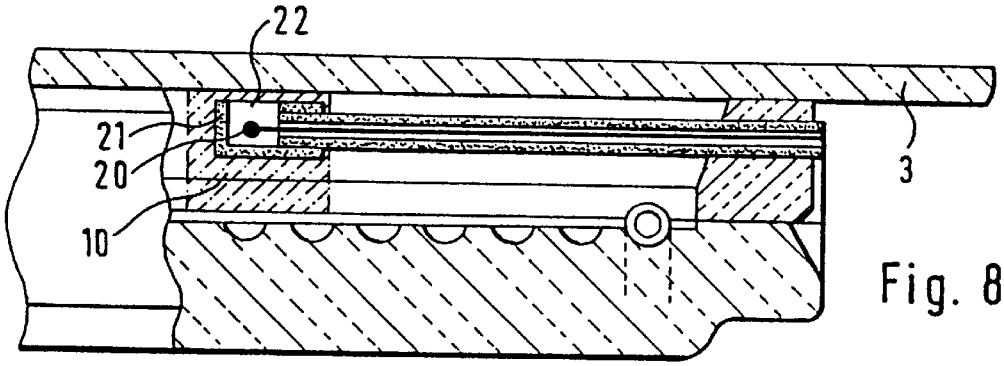
FIG. 8 is a partial section through a radiant heating body of yet another kind.

In FIG. 8 the cover cap 21 which is completely closed in FIG. 7 is provided with an opening 22 towards the plate 3.

Figure 9:
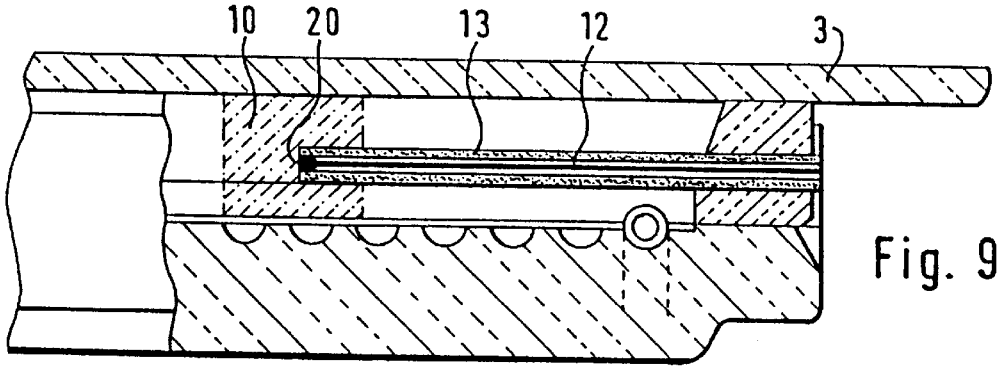
FIG. 9 shows a partial section through a radiant heating body of still another kind.

In the view shown in FIG. 9 the sensor head 20 of the temperature sensor 12 is set back behind a small opening at the end of the outer tube 13. The small opening at the end of the outer tube 13 in turn projects into the hottest region which is defined as the measurement zone.

Figure 10:
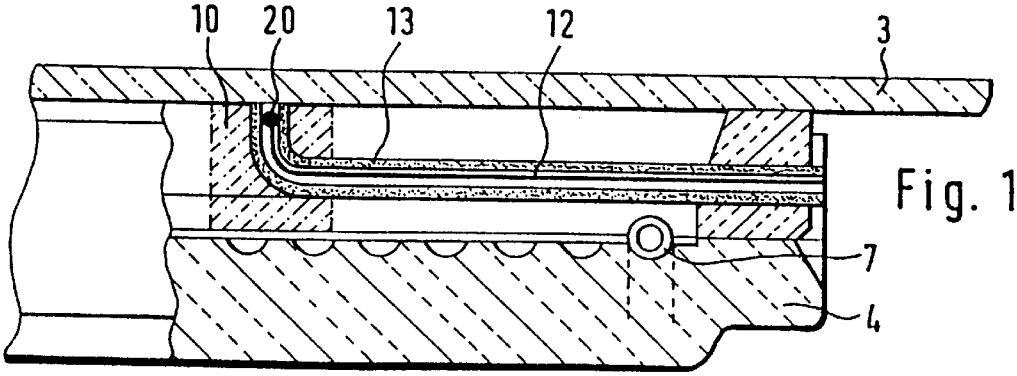
FIG. 10 shows a partial section through a radiant heating body of still another kind.

In FIG. 10 the outer tube 13 which is extended into the measurement zone or the hottest region 10 and which has the temperature sensor 12 disposed therein is bent over at a right angle relative to the glass ceramic plate 3 and has its open end directly against the underside of the glass ceramic plate 3. The sensor head 20 is disposed at a very small spacing beneath the underside of the glass ceramic plate 3. The bend configuration of the outer tube 13 is again disposed in the hottest region 10, as the so-called measurement zone.

It will be appreciated that other embodiments may also be envisaged in accordance with the invention, thus for example it would be possible to dispose directly on the underside of the glass ceramic plate tracks, as the temperature sensor, which are connected to a measurement position with a Pt-element.

We claim:

1. A radiant heating body (1) including a carrier (2) for at least one radiant heating resistor (7); a plate (3) covering said radiant heating resistor (7); a temperature limiter (11) including a temperature sensor (12), said plate (3) having a hottest region (10) which is calibrated in correlation with individual types or series of radiant heating bodies (1), wherein said temperature sensor (12) for direct determination of the temperature of the plate (3) is directed onto or in close proximity with the previously measured hottest region (10) of the plate (3).

2. A radiant heating body according to claim 1, wherein said temperature limiter (11) comprises a temperature monitor.

3. A radiant heating body according to claim 1, wherein the hottest region of said plate (3) has a small to punctiform surface extent.

4. A radiant heating body according to claim 1, wherein the temperature sensor (12) in the hottest region (10) of said plate (3) essentially contacts the underside of the plate (3).

5. A radiant heating body according to claim 1, wherein the temperature sensor (12) is sheathed electrically insulated, and said sensor has an end thereof which is selectively exposed extending towards the plate (3).

6. A radiant heating body according to claim 1, wherein the temperature sensor (12) is sheathed thermally insulated.

7. A radiant heating body according to claim 6, wherein the temperature sensor (12) is fitted into a tube-like sleeve (15).

8. A radiant heating body according to claim 7, wherein a spring (17) acts on the sleeve (15) which bears at an end against the underside of the plate (3).

9. A radiant heating body according to claim 7, wherein the sleeve (15) is acted upon by a thermally-reacting bimetallic spring (18) and in the hot condition bears against the underside of the plate (3).

10. A radiant heating body according to any one of claims 7, 8 or 9, wherein the sleeve (15) is closed at an end (14) which faces towards the plate (3).

11. A radiant heating body as claimed in claim 1, wherein said plate (3) is constituted of glass ceramic.

12. A radiant heating body according to claim 10, wherein the end (14) of the sleeve (15) which faces towards the plate (3) is glued to the plate (3).

13. A radiant heating body according to claim 1, wherein the sleeve (15) is a quartz tube or a ceramic tube.

14. A radiant heating body according to claims 1, wherein the plate (3) is formed from ceramic or an alloy steel.

* * * * *

UNITED STATES PATENT AND TRADEMARK OFFICE

CERTIFICATE OF CORRECTION

PATENT NO. : 5,877,475
DATED : March 2, 1999
INVENTOR(S) : J. Hecht, et al.

It is certified that error appears in the above-identified patent and that said Letters Patent is hereby corrected as shown below:

Column 6,
Line 23, claim 13: "claim 1" should read -- claim 7 --
Line 25, claim 14: "claims 1" should read -- claim 1--

Signed and Sealed this

Thirty-first Day of July, 2001

*Attest:*

Nicholas P. Godici

*Attesting Officer*

NICHOLAS P. GODICI
*Acting Director of the United States Patent and Trademark Office*